US009718269B2

(12) United States Patent
Duffield

(10) Patent No.: US 9,718,269 B2
(45) Date of Patent: Aug. 1, 2017

(54) MULTI-WAVEFORM INKJET NOZZLE CORRECTION

(71) Applicant: Electronics for Imaging, Inc., Fremont, CA (US)

(72) Inventor: John Duffield, Meredith, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 14/731,367

(22) Filed: Jun. 4, 2015

(65) Prior Publication Data

US 2016/0355009 A1 Dec. 8, 2016

(51) Int. Cl.
*B41J 2/045* (2006.01)

(52) U.S. Cl.
CPC ..... *B41J 2/04586* (2013.01); *B41J 2/0451* (2013.01); *B41J 2/0456* (2013.01); *B41J 2/04506* (2013.01); *B41J 2/04591* (2013.01)

(58) Field of Classification Search
CPC ..... B41J 2/04586; B41J 2/04588
See application file for complete search history.

(56) References Cited

U.S. PATENT DOCUMENTS 5,975,672 A * 11/1999 Wen ..... B41J 2/04 347/11
5,997,124 A 12/1999 Capps et al.
6,046,822 A * 4/2000 Wen ..... B41J 2/04573 347/15
6,315,383 B1 11/2001 Sarmast et al.
6,352,328 B1 * 3/2002 Wen ..... B41J 2/04 347/11
6,422,677 B1 7/2002 Deshpande et al.
6,428,134 B1 * 8/2002 Clark ..... B41J 2/04506 347/10
8,056,999 B2 11/2011 Gardner et al.
8,851,601 B2 10/2014 Zhang et al.
2005/0179739 A1 * 8/2005 Freire ..... B41J 2/0458 347/61
2011/0193908 A1 8/2011 Araszkiewiez

* cited by examiner

*Primary Examiner* — Bradley Thies
(74) *Attorney, Agent, or Firm* — Michael A. Glenn; Perkins Coie LLP

(57) ABSTRACT

The uniformity of performance of inkjet nozzles within a print head containing a plurality of said nozzles is optimized by characterizing one or more performance attributes of the nozzles within said print head. A waveform set is generated that comprises a plurality of waveforms to compensate for variations of the one or more performance attributes among the nozzles. One of the waveforms within the waveform set is assigned to each nozzle to optimize the one or more performance attributes of each nozzle relative to each other nozzle in the print head. Based upon the waveform assigned to each nozzle, each nozzle in the print head responds substantially uniformly relative to each other nozzle in the print head.

15 Claims, 12 Drawing Sheets

MULTI-WAVEFORM INKJET NOZZLE CORRECTION

FIELD

The invention relates to printing. More particularly, the invention relates to multi-waveform inkjet nozzle correction.

BACKGROUND

State of the art industrial print head designs use one, identical waveform to drive all nozzles in the print head. In such print heads, gray scale printing uses parts of the same waveform, which compromises performance and consistency. This approach results in common print defects, such as drop volume variation, drop velocity differences, and print density defects.

SUMMARY

The uniformity of performance of inkjet nozzles within a print head containing a plurality of said nozzles is optimized by characterizing one or more performance attributes of the nozzles within said print head. A waveform set is generated that comprises a plurality of waveforms to compensate for variations of the one or more performance attributes among the nozzles. One of the waveforms within the waveform set is assigned to each nozzle to optimize the one or more performance attributes of each nozzle relative to each other nozzle in the print head. Based upon the waveform assigned to each nozzle, each nozzle in the print head responds substantially uniformly relative to each other nozzle in the print head.

DETAILED DESCRIPTION

Figure 1:
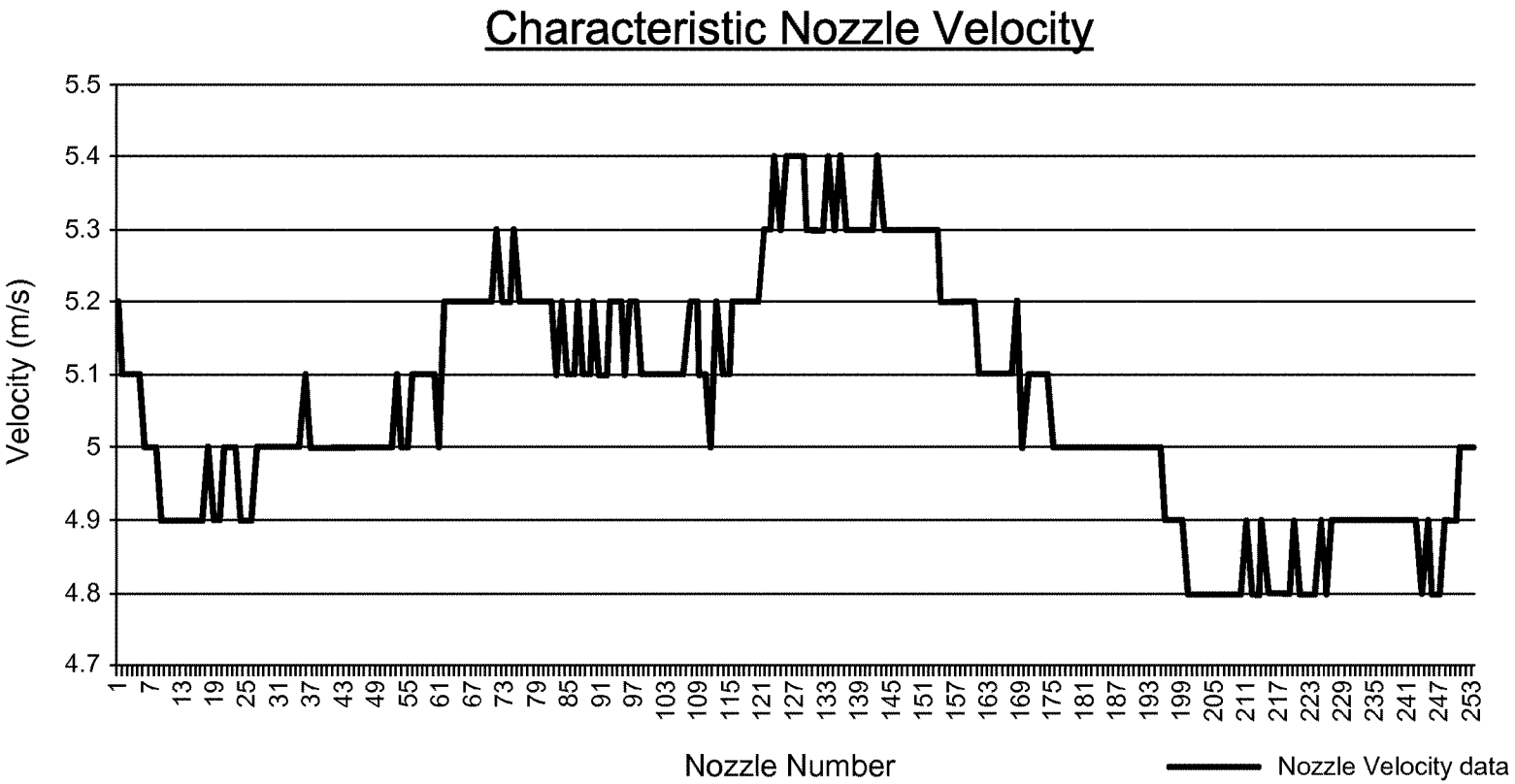
FIGURE 1 (PRIOR ART)
FIG. 1 is a graph that shows the velocity data provided by the manufacturer for one of the two channels in a print head.

The uniformity of performance of inkjet nozzles within a print head containing a plurality of said nozzles is optimized by characterizing one or more performance attributes of the nozzles within said print head. A waveform set is generated that comprises a plurality of waveforms to compensate for variations of the one or more performance attributes among the nozzles. One of the waveforms within the waveform set is assigned to each nozzle to optimize the one or more performance attributes of each nozzle relative to each other nozzle in the print head. Based upon the waveform assigned to each nozzle, each nozzle in the print head responds substantially uniformly relative to each other nozzle in the print head.

Some embodiments of the invention provide correction of variations of the one or more performance attributes among the nozzles by selecting different waveforms to drive individual nozzles in a print head. First, consider the concept of correcting variations of the one or more performance attributes among the nozzles that manifest themselves as a specific defect based on the print head manufacturers' final test data. Modern industrial inkjet print heads typically have hundreds of nozzles per unit, some have over 2000. The cost of these units ranges from about $1/nozzle to as much as $10/nozzle. The less expensive print heads typically have more variation and defects and the presently preferred embodiments of the invention is, at least in some embodiments, directed to these print heads.

Most print head manufacturers produce final test data on every print head, while some provide this data on a per-nozzle basis. These data include factors attributes such as nozzle velocity, directionality, mechanical tolerances, etc. Embodiments of the invention use some of this data to correct the more critical variations in the print head, based on individual control of each nozzle. Velocity variation by nozzle, as shown in Table 1 below, is an example of a defect that is corrected in this way.

TABLE 1

Velocity Variation by Nozzle

| Nozzle # | Velocity m/s | Waveform |
|---|---|---|
| 1 | 5.2 | 3 |
| 2 | 5.1 | 4 |
| 3 | 5.1 | 4 |
| 4 | 5.1 | 4 |
| 5 | 5.1 | 4 |
| 6 | 5 | 5 |
| 7 | 5 | 5 |
| 8 | 5 | 5 |
| 9 | 4.9 | 6 |
| 10 | 4.9 | 6 |
| 11 | 4.9 | 6 |
| 12 | 4.9 | 6 |
| 13 | 4.9 | 6 |
| 14 | 4.9 | 6 |
| 15 | 4.9 | 6 |
| 16 | 4.9 | 6 |
| 17 | 4.9 | 6 |
| 18 | 5 | 5 |
| 19 | 4.9 | 6 |
| 20 | 4.9 | 6 |
| 21 | 5 | 5 |
| 22 | 5 | 5 |

TABLE 1-continued

Velocity Variation by Nozzle

| Nozzle # | Velocity m/s | Waveform |
|---|---|---|
| 23 | 5 | 5 |
| 24 | 4.9 | 6 |
| 25 | 4.9 | 6 |
| 26 | 4.9 | 6 |
| 27 | 5 | 5 |
| 28 | 5 | 5 |
| 29 | 5 | 5 |
| 30 | 5 | 5 |
| 31 | 5 | 5 |
| 32 | 5 | 5 |
| 33 | 5 | 5 |
| 34 | 5 | 5 |
| 35 | 5 | 5 |
| 36 | 5.1 | 4 |
| 37 | 5 | 5 |
| 38 | 5 | 5 |
| 39 | 5 | 5 |
| 40 | 5 | 5 |
| 41 | 5 | 5 |
| 42 | 5 | 5 |
| 43 | 5 | 5 |
| 44 | 5 | 5 |
| 45 | 5 | 5 |
| 46 | 5 | 5 |
| 47 | 5 | 5 |
| 48 | 5 | 5 |
| 49 | 5 | 5 |
| 50 | 5 | 5 |
| 51 | 5 | 5 |
| 52 | 5 | 5 |
| 53 | 5.1 | 4 |
| 54 | 5 | 5 |
| 55 | 5 | 5 |
| 56 | 5.1 | 4 |
| 57 | 5.1 | 4 |
| 58 | 5.1 | 4 |
| 59 | 5.1 | 4 |
| 60 | 5.1 | 4 |
| 61 | 5 | 5 |
| 62 | 5.2 | 3 |
| 63 | 5.2 | 3 |
| 64 | 5.2 | 3 |
| 65 | 5.2 | 3 |
| 66 | 5.2 | 3 |
| 67 | 5.2 | 3 |
| 68 | 5.2 | 3 |
| 69 | 5.2 | 3 |
| 70 | 5.2 | 3 |
| 71 | 5.2 | 3 |
| 72 | 5.3 | 2 |
| 73 | 5.2 | 3 |
| 74 | 5.2 | 3 |
| 75 | 5.3 | 2 |
| 76 | 5.2 | 3 |
| 77 | 5.2 | 3 |
| 78 | 5.2 | 3 |
| 79 | 5.2 | 3 |
| 80 | 5.2 | 3 |
| 81 | 5.2 | 3 |
| 82 | 5.2 | 3 |
| 83 | 5.1 | 4 |
| 84 | 5.2 | 3 |
| 85 | 5.1 | 4 |
| 86 | 5.1 | 4 |
| 87 | 5.2 | 3 |
| 88 | 5.1 | 4 |
| 89 | 5.1 | 4 |
| 90 | 5.2 | 3 |
| 91 | 5.1 | 4 |
| 92 | 5.1 | 4 |
| 93 | 5.2 | 3 |
| 94 | 5.2 | 3 |
| 95 | 5.2 | 3 |
| 96 | 5.1 | 4 |
| 97 | 5.2 | 3 |
| 98 | 5.2 | 3 |

TABLE 1-continued

Velocity Variation by Nozzle

| Nozzle # | Velocity m/s | Waveform |
|---|---|---|
| 99 | 5.1 | 4 |
| 100 | 5.1 | 4 |
| 101 | 5.1 | 4 |
| 102 | 5.1 | 4 |
| 103 | 5.1 | 4 |
| 104 | 5.1 | 4 |
| 105 | 5.1 | 4 |
| 106 | 5.1 | 4 |
| 107 | 5.1 | 4 |
| 108 | 5.2 | 3 |
| 109 | 5.2 | 3 |
| 110 | 5.1 | 4 |
| 111 | 5.1 | 4 |
| 112 | 5 | 5 |
| 113 | 5.2 | 3 |
| 114 | 5.1 | 4 |
| 115 | 5.1 | 4 |
| 116 | 5.2 | 3 |
| 117 | 5.2 | 3 |
| 118 | 5.2 | 3 |
| 119 | 5.2 | 3 |
| 120 | 5.2 | 3 |
| 121 | 5.2 | 3 |
| 122 | 5.3 | 2 |
| 123 | 5.3 | 2 |
| 124 | 5.4 | 1 |
| 125 | 5.3 | 2 |
| 126 | 5.4 | 1 |
| 127 | 5.4 | 1 |
| 128 | 5.4 | 1 |
| 129 | 5.4 | 1 |
| 130 | 5.3 | 2 |
| 131 | 5.3 | 2 |
| 132 | 5.3 | 2 |
| 133 | 5.3 | 2 |
| 134 | 5.4 | 1 |
| 135 | 5.3 | 2 |
| 136 | 5.4 | 1 |
| 137 | 5.3 | 2 |
| 138 | 5.3 | 2 |
| 139 | 5.3 | 2 |
| 140 | 5.3 | 2 |
| 141 | 5.3 | 2 |
| 142 | 5.3 | 2 |
| 143 | 5.4 | 1 |
| 144 | 5.3 | 2 |
| 145 | 5.3 | 2 |
| 146 | 5.3 | 2 |
| 147 | 5.3 | 2 |
| 148 | 5.3 | 2 |
| 149 | 5.3 | 2 |
| 150 | 5.3 | 2 |
| 151 | 5.3 | 2 |
| 152 | 5.3 | 2 |
| 153 | 5.3 | 2 |
| 154 | 5.3 | 2 |
| 155 | 5.2 | 3 |
| 156 | 5.2 | 3 |
| 157 | 5.2 | 3 |
| 158 | 5.2 | 3 |
| 159 | 5.2 | 3 |
| 160 | 5.2 | 3 |
| 161 | 5.2 | 3 |
| 162 | 5.1 | 4 |
| 163 | 5.1 | 4 |
| 164 | 5.1 | 4 |
| 165 | 5.1 | 4 |
| 166 | 5.1 | 4 |
| 167 | 5.1 | 4 |
| 168 | 5.1 | 4 |
| 169 | 5.2 | 3 |
| 170 | 5 | 5 |
| 171 | 5.1 | 4 |
| 172 | 5.1 | 4 |
| 173 | 5.1 | 4 |
| 174 | 5.1 | 4 |

TABLE 1-continued

| Velocity Variation by Nozzle | | |
|---|---|---|
| Nozzle # | Velocity m/s | Waveform |
| 175 | 5.1 | 4 |
| 176 | 5 | 5 |
| 177 | 5 | 5 |
| 178 | 5 | 5 |
| 179 | 5 | 5 |
| 180 | 5 | 5 |
| 181 | 5 | 5 |
| 182 | 5 | 5 |
| 183 | 5 | 5 |
| 184 | 5 | 5 |
| 185 | 5 | 5 |
| 186 | 5 | 5 |
| 187 | 5 | 5 |
| 188 | 5 | 5 |
| 189 | 5 | 5 |
| 190 | 5 | 5 |
| 191 | 5 | 5 |
| 192 | 5 | 5 |
| 193 | 5 | 5 |
| 194 | 5 | 5 |
| 195 | 5 | 5 |
| 196 | 5 | 5 |
| 197 | 4.9 | 6 |
| 198 | 4.9 | 6 |
| 199 | 4.9 | 6 |
| 200 | 4.9 | 6 |
| 201 | 4.8 | 7 |
| 202 | 4.8 | 7 |
| 203 | 4.8 | 7 |
| 204 | 4.8 | 7 |
| 205 | 4.8 | 7 |
| 206 | 4.8 | 7 |
| 207 | 4.8 | 7 |
| 208 | 4.8 | 7 |
| 209 | 4.8 | 7 |
| 210 | 4.8 | 7 |
| 211 | 4.8 | 7 |
| 212 | 4.9 | 6 |
| 213 | 4.8 | 7 |
| 214 | 4.8 | 7 |
| 215 | 4.9 | 6 |
| 216 | 4.8 | 7 |
| 217 | 4.8 | 7 |
| 218 | 4.8 | 7 |
| 219 | 4.8 | 7 |
| 220 | 4.8 | 7 |
| 221 | 4.9 | 6 |
| 222 | 4.8 | 7 |
| 223 | 4.8 | 7 |
| 224 | 4.8 | 7 |
| 225 | 4.8 | 7 |
| 226 | 4.9 | 6 |
| 227 | 4.8 | 7 |
| 228 | 4.9 | 6 |
| 229 | 4.9 | 6 |
| 230 | 4.9 | 6 |
| 231 | 4.9 | 6 |
| 232 | 4.9 | 6 |
| 233 | 4.9 | 6 |
| 234 | 4.9 | 6 |
| 235 | 4.9 | 6 |
| 236 | 4.9 | 6 |
| 237 | 4.9 | 6 |
| 238 | 4.9 | 6 |
| 239 | 4.9 | 6 |
| 240 | 4.9 | 6 |
| 241 | 4.9 | 6 |
| 242 | 4.9 | 6 |
| 243 | 4.9 | 6 |
| 244 | 4.9 | 6 |
| 245 | 4.8 | 7 |
| 246 | 4.9 | 6 |
| 247 | 4.8 | 7 |
| 248 | 4.8 | 7 |
| 249 | 4.9 | 6 |
| 250 | 4.9 | 6 |

TABLE 1-continued

| Velocity Variation by Nozzle | | |
|---|---|---|
| Nozzle # | Velocity m/s | Waveform |
| 251 | 4.9 | 6 |
| 252 | 5 | 5 |
| 253 | 5 | 5 |
| 254 | 5 | 5 |

FIG. 1 is a graph that shows the velocity data provided by the manufacturer for one of the two channels in a print head. This data shows that the variation in nozzle velocity from nozzle #1 to nozzle #254 is 5.1 m/s (+–6%). By creating specific waveform sets, e.g. seven different waveforms, see Table 2 below, one can apply the waveforms that drive the nozzles slower to the nozzles that appear faster in the data, and vice versa, to counteract the differences in velocities.

TABLE 2

| Specific Waveform Sets | |
|---|---|
| Velocity m/s | Waveform # |
| 4.8 | 7 |
| 4.9 | 6 |
| 5.0 | 5 |
| 5.1 | 4 |
| 5.2 | 3 |
| 5.3 | 2 |
| 5.4 | 1 |

Figure 2:
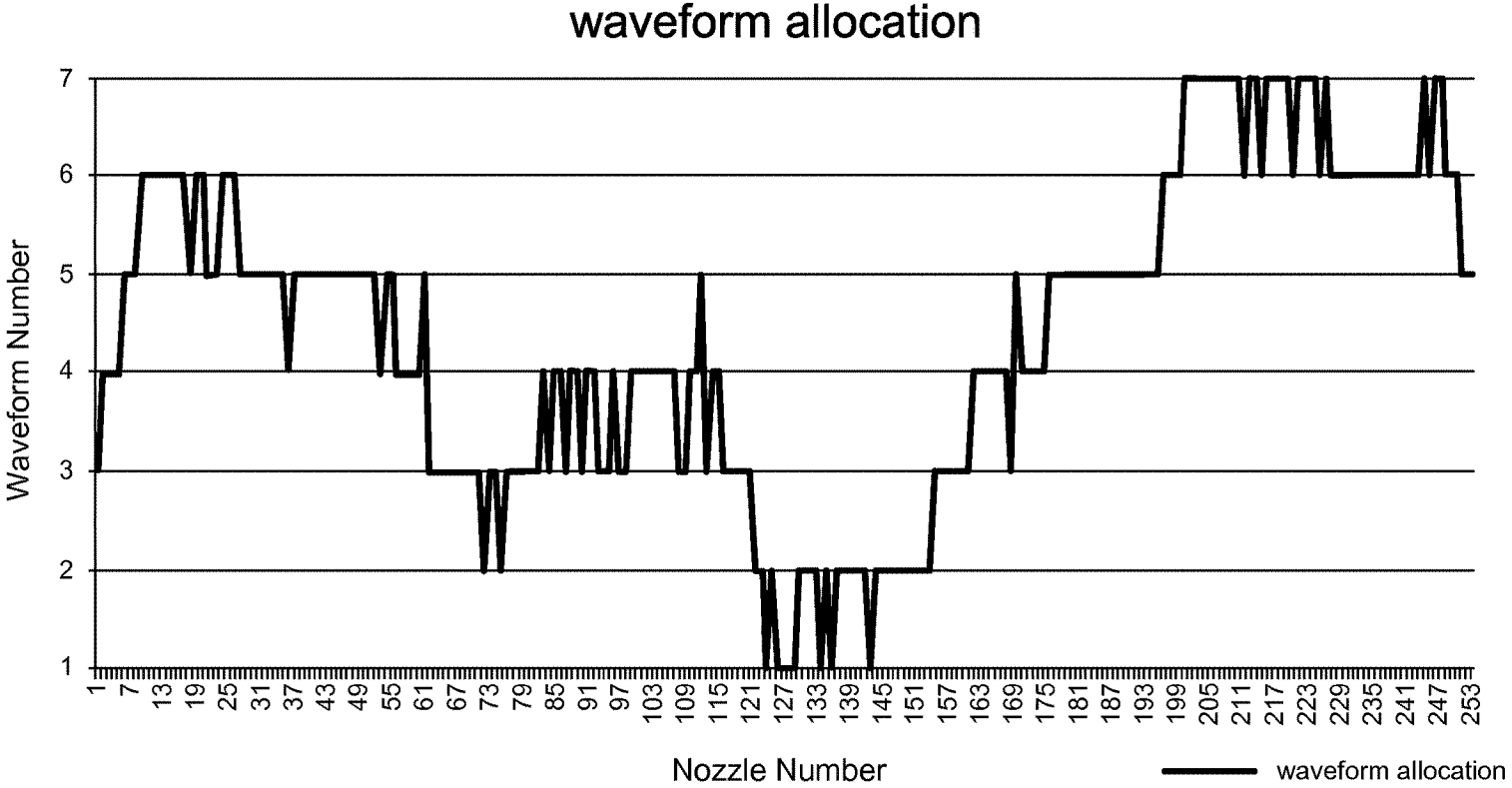
FIG. 2 is a graph that shows waveform mapping of the individual print nozzles in view of the velocity data provided by the manufacturer for one of the two channels in a print head according to the invention.

FIG. 2 is a graph that shows waveform mapping of the individual print nozzles in view of the velocity data provided by the manufacturer for one of the two channels in a print head. Taking the data literally, it can be seen that the waveform mapping is a mirror image of the velocity data. A fast nozzle that fires at 6% above the average, i.e. 5.4 m/s, when driven by waveform 7 should slow down by 6% and fire at 5.1 m/s. A slow nozzle that fires at 6% below the average, i.e. 4.8 m/s, when driven by waveform 1 should speed up by 6% and fire at 5.1 m/s. Ideally, once this correction is applied, all nozzles fire at 5.1 m/s, giving the appearance of a very uniform, more expensive print head.

Manufacturer velocity data is just one of the pieces of raw data that can be used in the invention to correct variations in performance attributes, e.g. defects in the print heads, by manipulating the waveforms sent to each nozzle. However, this may not be the most effective way of correcting, for example, velocity defects because the manufacturer may generate this data on a piece of equipment that does not represent the real life application of the print head, e.g. static v. reciprocating, test fluid v. UV ink, different firing frequency, etc.

In embodiments of the invention, a more accurate method of generating data is to:

a. Print specific test patterns on the printer, with the correct ink, at the correct frequency (speed), and in exactly the same way images are produced on that device;

b. Capture a very precise digital image of the test pattern, either by a camera or scanner;

c. Apply image analysis to determine one or more of the performance attributes of the drops of ink, i.e. size, shape, position, satellites, etc.

d. Extract these performance attributes to generate a printer and print head specific waveform mapping to correct the defects to provide a more precise applicable result than that provided by the manufacturer's data.

Using the above approach, one can also capture and analyze other defects that do not show up in any raw data, and to which the herein disclosed waveform correction can be applied. Such defects can include, for example, generic density shifts in a finished image.

Often with less expensive print heads one relies on random errors cancelling each other out by interlacing multiple, e.g. four or more, print passes to complete an image. Unfortunately, in some of the faster print modes these minor print head defects accumulate to form more major defects that can be seen by the naked eye.

Figure 3:
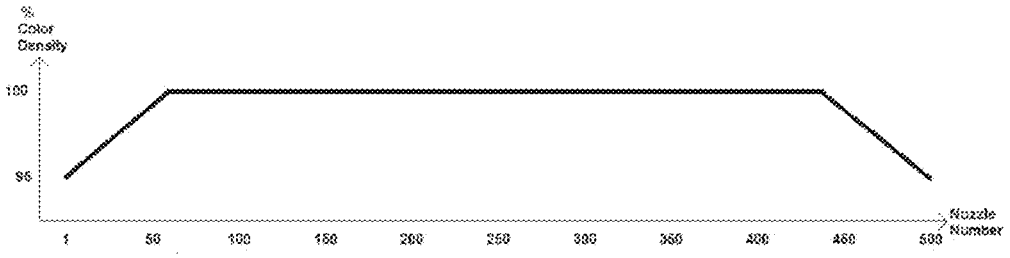
FIG. 3 is a graph that shows analyzed color density by nozzle according to the invention.

When a generic defect, such as a consistent color density shift, is detected the image can be analyzed to determine the severity and amplitude of the defect. A specific test print, designed to enhance the defect, is created and printed on the printer in a specific print mode and usually using only one color channel. The finished test print is then digitally captured using a high resolution camera or scanner. An analysis tool is the applied to the captured image to quantify the defect. The output of this analysis tool is typically in graphical form, so the density defect can easily be corrected. See FIG. 3, which is a graph that shows analyzed color density by nozzle.

Figure 4:
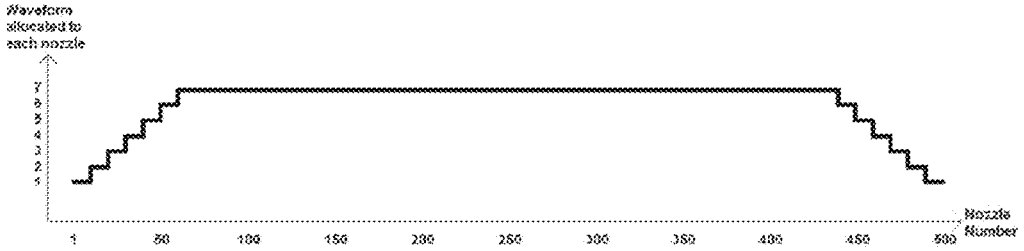
FIG. 4 is a graph that shows a waveform allocated to nozzles according to the invention.

Once the defect can be displayed in the graphical form, a second tool is used to apply waveform correction to the print heads. In its simplest form, embodiments of the invention apply a stepped change to the waveform. See FIG. 4, which is a graph that shows a waveform allocated to nozzles.

Figure 5:
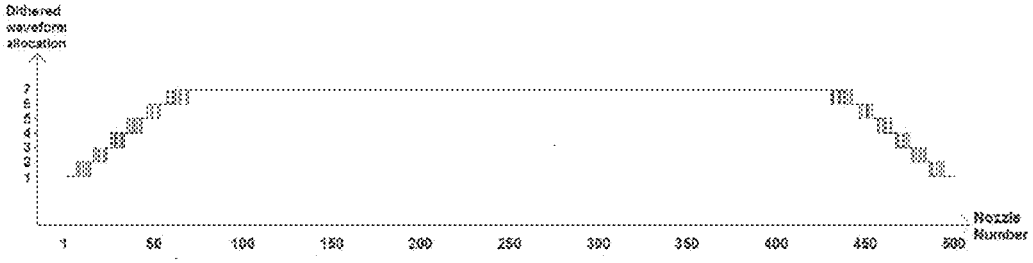
FIG. 5 is a graph that shows dithered waveform allocation according to the invention.

Although in most cases this level of sophistication is sufficient to correct 80% of the density defects, some more severe defects require a high amplitude of correction. When using larger increments (>1%) between waveforms, critical images show the step transition between them, creating their own defects. To combat these step defects it is necessary to dither between waveforms to mask the transition between them. See FIG. 5, which is a graph that shows dithered waveform allocation. A tool that is used to apply the waveform correction to this defect is provided with a level of sophistication that automatically dithers between waveform steps.

Operation

Figure 6:
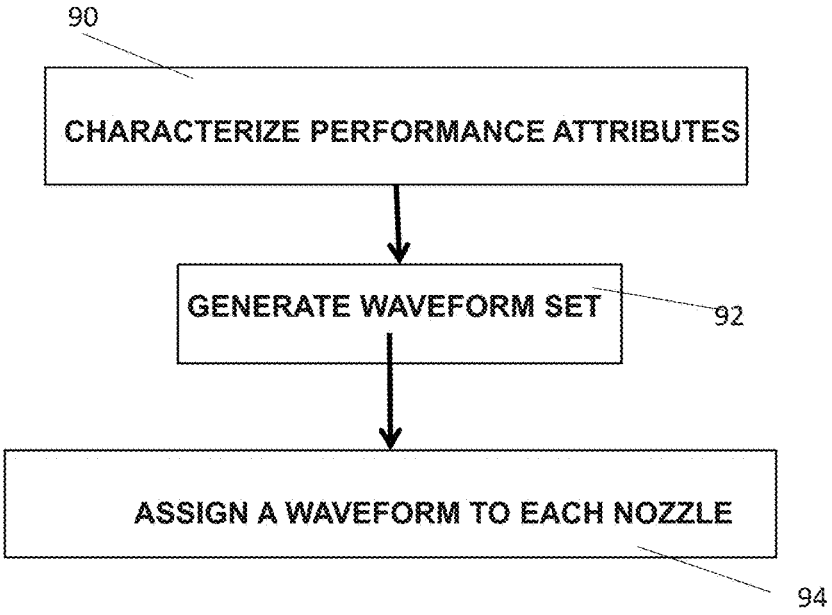
FIG. 6 is a flow diagram showing a method for optimizing the uniformity of performance of inkjet nozzles within a print head containing a plurality of said nozzles according to the invention.

FIG. 6 is a flow diagram showing a method for optimizing the uniformity of performance of inkjet nozzles within a print head containing a plurality of said nozzles. In FIG. 6, the nozzles across a print head are optimized by characterizing one or more performance attributes of the nozzles within the print head (90). The performance attributes comprise any of droplet velocity, droplet volume, droplet mass, optical density produced by the print head, gloss level, and temperature of the print head. In embodiments of the invention, one or more performance attributes are characterized with a printed test pattern that is subsequently imaged and analyzed.

A waveform set is generated (92) that comprises a plurality of waveforms to compensate for variations of the one or more performance attributes among the nozzles. One of the waveforms within the waveform set is assigned to each nozzle (94) to optimize the one or more performance attributes of each nozzle relative to each other nozzle in the print head.

Based upon the waveform assigned to each nozzle, each nozzle in the print head responds substantially uniformly relative to each other nozzle in the print head.

The waveform set comprises a discrete, finite set of waveforms. A dithering operation is used to assign one of the waveforms to each nozzle. The dithering operation is also used to smooth transitions between the discrete waveforms.

In embodiments of the invention, performance of a predetermined portion of the nozzles of the print head is used as a baseline. The nozzles outside of the predetermined portion are adjusted by assigning a waveform to the outside nozzles to adjust the outside nozzles to approximate performance of the nozzles within the predetermined portion.

Embodiments of the invention also comprise a scanning printer, in which uniformity of a performance attribute produced by a given color channel is improved by characterizing a combined average of the performance attribute of all print heads within the printer. A waveform is selected from the waveform set for each print head nozzle to make the performance attribute more uniform across the print head nozzles. The same selected waveform is applied to each print head that prints the given color channel. The performance attribute comprise any of droplet velocity, droplet volume, droplet mass, optical density produced by the print head, gloss level, and temperature of the print head. In embodiments of the invention, one or more performance attributes are characterized with a printed test pattern that is subsequently imaged and analyzed.

Alternate Embodiment

Figure 7:
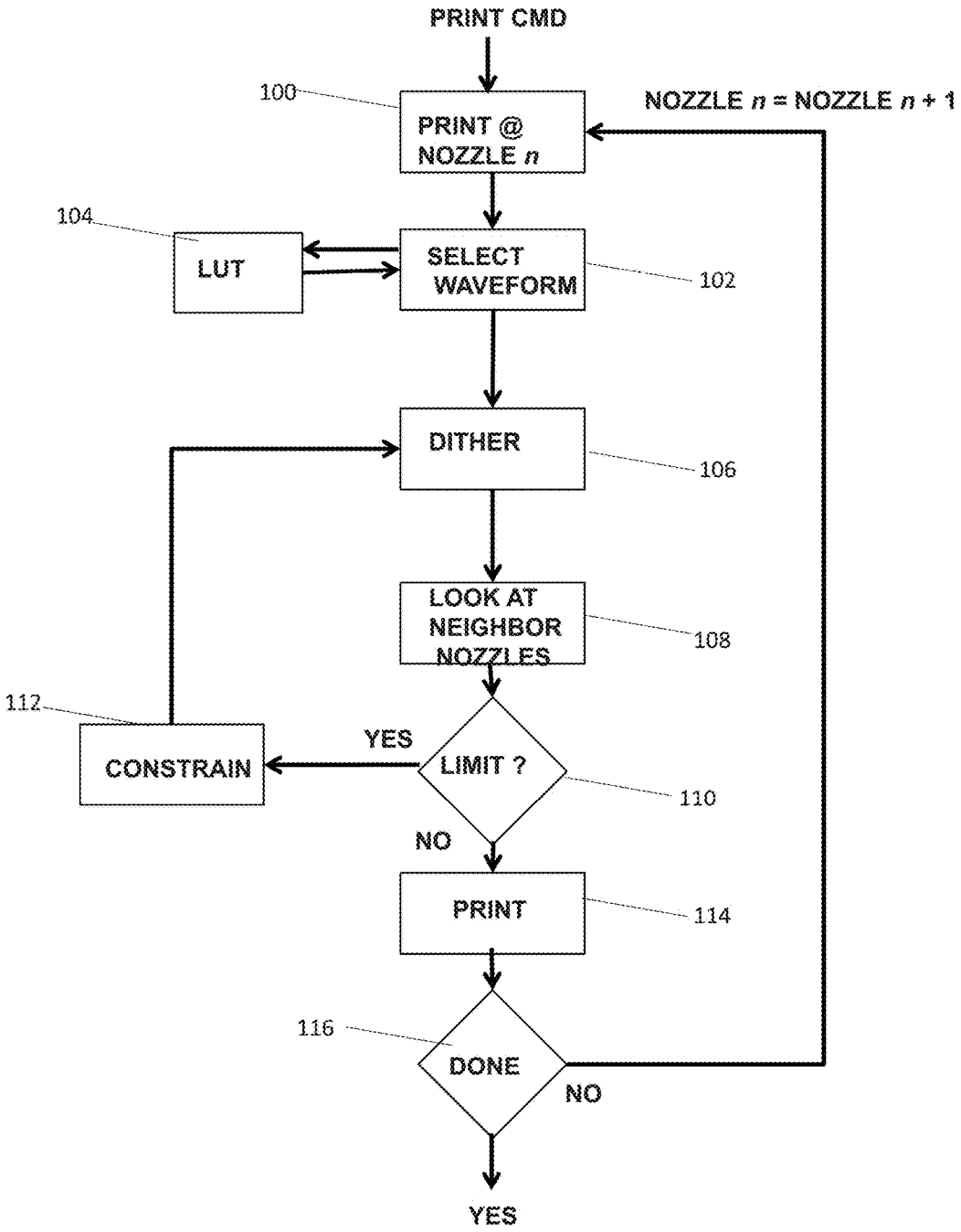
FIG. 7 is a flow diagram showing a method for multi-waveform inkjet nozzle correction according to another embodiment of the invention.

FIG. 7 is a flow diagram showing a method for multi-waveform inkjet nozzle correction according to another embodiment of the invention. Embodiments of the invention provide correction of specific print defects by selecting different waveforms to drive individual nozzles in a print head. In some embodiments of the invention, a characteristic curve is generated to negate print head defects and waveform values for each nozzle in the print head are stored in a look-up table. In some embodiments of the invention, a dither pattern is then super-imposed onto the curve to blend in changes. In embodiments of the invention, parts of the curve require a continuous response, set to a baseline waveform, to keep consistent color and performance. Other embodiments of the invention use print head characteristic data, i.e. individual nozzle velocities, to generate specific drive patterns to correct dot placement errors due to the variations. Embodiments of the invention also limit the neighboring dither delta to, for example, a 0.1-0.5 μs pulse on time to avoid steps and cross talk defects.

In FIG. 7, a print command is received at the printer for the printer to print at two or more nozzles in a print head within the printer. Thus, the printer gets ready to print at nozzle n (100). A waveform is selected (102) from a lookup table (104) and applied to nozzle n. In embodiments of the invention, a dither pattern is applied 106, where the size of the waveform at neighboring nozzles is examined (108) to determine if it is beyond a limit (110). If so, then the waveform adjustment for the nozzle is constrained (112); else, the nozzle is allowed to print with the adjusted waveform (114). If the print is complete (116) the process ends; else. nozzle n is incremented and the process repeats from nozzle n+1.

Figure 8:
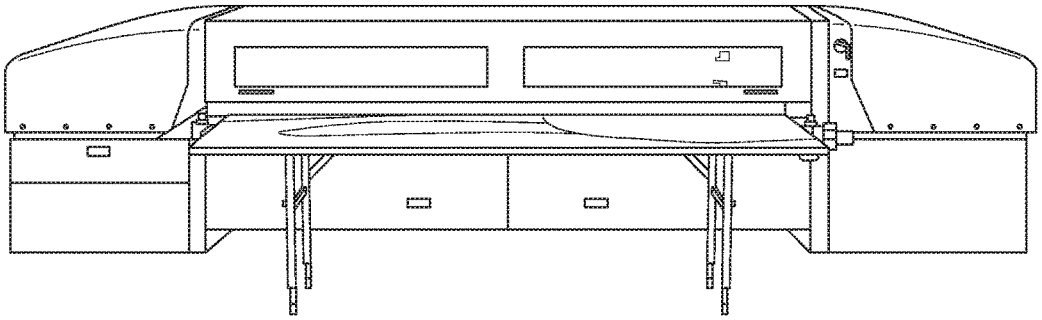
FIG. 8 is a perspective view of a printer for use in accordance with the invention.
Figure 9:
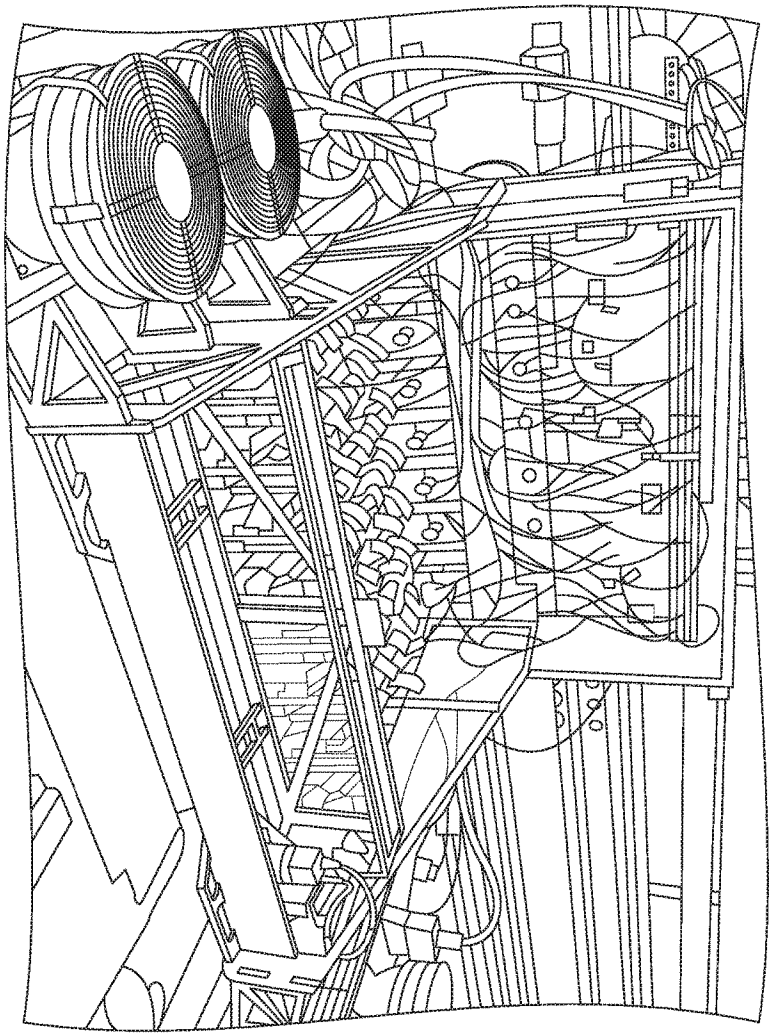
FIG. 9 perspective view of a printer carriage for use in accordance with the invention.
Figure 10:
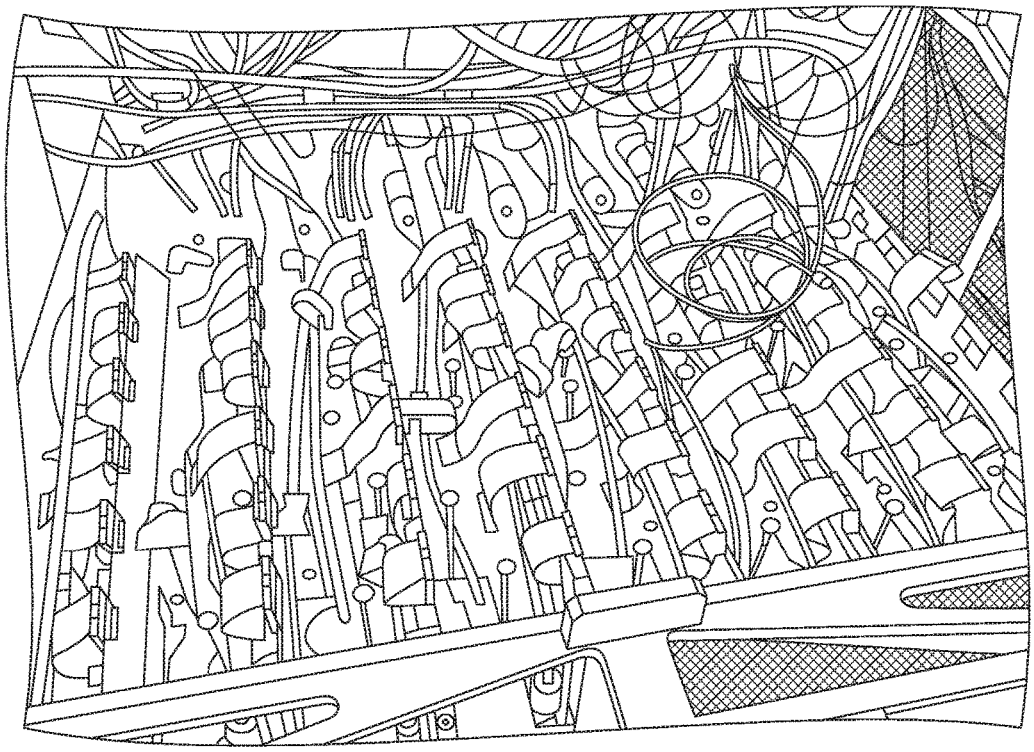
FIG. 10 is a perspective view of a printer print head layout for use in accordance with the invention.
Figure 11:
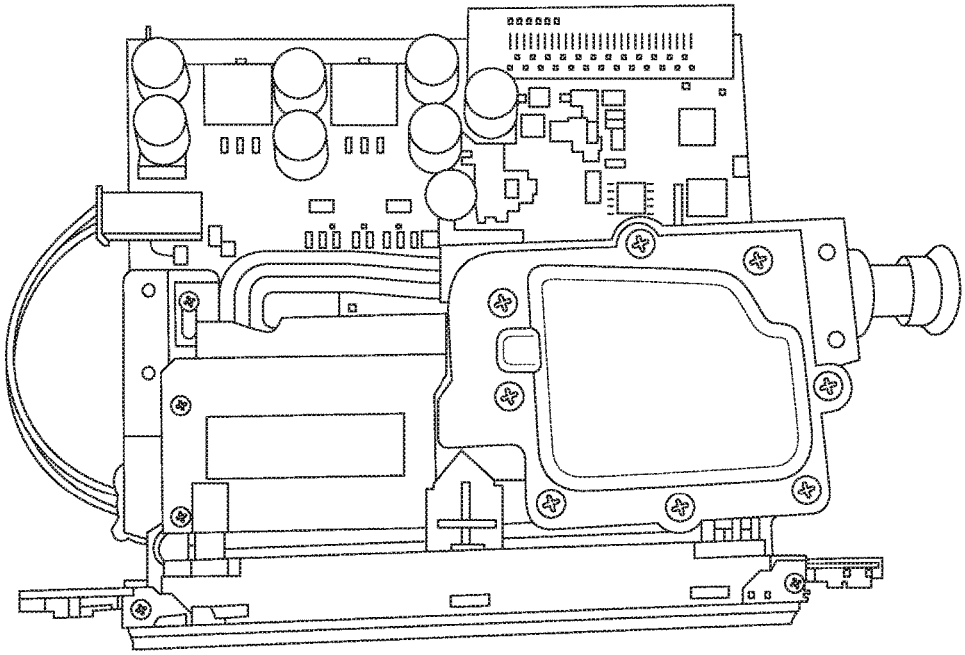
FIG. 11 is a perspective view of a printer print head for use in accordance with the invention.

Embodiments of the invention are practiced in connection with industrial print heads used in a high-speed digital UV inkjet press, such as the Vutek HS100. FIG. 8 is a perspective view of a printer for use in accordance with the invention; FIG. 9 perspective view of a printer carriage for use in accordance with the invention; FIG. 10 is a perspective view of a printer print head layout for use in accordance with the invention; and FIG. 11 is a perspective view of a printer print head for use in accordance with the invention.

Modern printers can have fifty or more print heads. The print heads can cost $1000-2000 each. To be able to use a lower cost print head but achieve the quality of a high cost print head is advantageous. Embodiments of the invention characterize each of the print head nozzles individually, and create a library of lookup tables for the print heads, such that each nozzle gives almost an identical performance to each other nozzle even though there may be variations, for example, due to temperature. This allows the use of lower quality and/or less expensive print heads in the printer.

In embodiments of the invention, each of the inkjet nozzles is driven with a different waveform. This allows for correction of specific print head defects. The system drives each nozzles a little harder or a little softer to make the drop come out relatively faster and larger or smaller and slower. If the defect involves slow nozzles or fast nozzles, then the defect can be corrected by speeding up or slowing down one or more of the nozzle by giving each nozzle a different waveform.

Typically, the print head manufacturer provides data on characteristic nozzle velocities. These velocities are altered in embodiments of the invention by varying the pulse width of the waveform delivered to each nozzle where, to a point, a wider pulse delivers more energy and thus results in a higher ink velocity, and a narrow pulse delivers less energy and thus results in a lower ink velocity. It should be appreciated that the width of the pulse may, at some point, no longer increase ink velocity due to resonant and non-resonant effects. Further, other approaches may be used to alter the ink velocity.

Recent developments show that some defects are caused not by drop volume or velocity as characterized by test data. For example, differential heating of the print head causes cooler nozzles to fire smaller slower drops. To correct for this, variable waveforms are used to counteract and to boost the lazy nozzles. Also, additional non-firing pulses can be applied to the lazy nozzle region of the head to induce heat. Localized heating of the head offsets the temperature differential, creating a more uniform response. Thus, a key defect to correct is a temperature defect, where the head tends to be cooler at the end than it is in the middle. The cooler nozzles tend to fire weaker and slower. Embodiments of the invention drive the nozzles at the end harder to correct this defect. The waveforms that are used to drive the print head nozzles are typically a square wave, but each waveform has a different pulse width, as discussed above. Other waveform shapes may be used, however, in other embodiments of the invention.

In a presently preferred embodiment of the invention, the print heads are gray scale heads that can be addressed with a single pulse, which is one square wave of nozzle-on time. The single pulse of nozzle-on time is typically from 6 to 10 microseconds. With different heads and under different applications the pulse width may be outside of that range, and this range is only provided as an example of what would cause the ink drops to come out of each nozzle faster or slower. In embodiments of the invention, the value for the waveform can also be determined empirically by trial and error.

In a presently preferred embodiment of the invention, however, waveforms are created by printing with the waveforms and measuring the output to determine ink velocity and drop volume, and to see how the nozzles vary with each of the different waveforms. Thus, the nozzles are characterized to understand how they respond to different waveforms. For each print head in each printer, the waveforms are set in the printer hardware by a software generator and, as such, in some embodiments the waveforms can be changed on the fly. The waveforms can be set for each nozzle in different individual print heads or they can be set for each printer to characterize all print heads. The presently preferred embodiment of the invention looks at the average of all of the print heads, e.g. their response, the average of each color, and then drives each of the nozzles with an average waveform for that nozzle.

In some embodiments of the invention a lookup table is created that contains the waveforms. A presently preferred embodiment of the invention provides a lookup table that has between 25 and 30 different waveform sets. Thus, it is possible to use a full set of waveforms for a print head, e.g. seven or eight waveforms, at any one time. Within the lookup table, the printer can include 30 sets of seven waveforms.

There are two adjustments in the presently preferred embodiment of the invention: a mapping adjustment and a waveform set adjustment.

The mapping adjustment maps every nozzle in a print head to a specific reference point, e.g. zero to seven a 3-bit system, where zero is the baseline waveform. Thus, the baseline for the waveform set is zero, where a very fast waveform is seven. Accordingly, in this embodiment there are eight different waveforms from slow to fast or small to large. By changing the delta from top to bottom, one can control the amount of adjustment in the head with one characteristic mapping of each nozzle for all of the heads. A user interface in embodiments of the invention includes a slider that allows a user to increase or decrease the delta in the waveforms between each nozzle.

If the end 25 nozzles of a print head are slow, but they are not all slow by the same amount, the characteristic at the end of the print head is mapped and a correction is applied from zero to seven in the last 25 nozzles. In the middle nozzles, there is likely more noise than there is variation, and a baseline waveform is applied to these nozzles.

The mapping is changed in response to characterizing a defect. The characterization results in a waveform ramp that ends the defect to be corrected. Such defect is mapped by analysis and a characteristic map of that defect is created. In effect, the inverse of the defect is generated by adjusting the nozzle waveform, as is required to negate the defect. The adjustment to each waveform is mapped to the print head and stored in a look-up table. As noted above, in embodiments of the invention the mapping can be created individually for individual heads, although other embodiments of the invention send the same mapping to all print heads in the printer, e.g. the same mapping of each individual nozzle is used for each of the, for example 48 print heads, in the printer.

The second adjustment adjusts the waveform sets themselves. As discussed above, the exemplary mapping goes from zero to seven, although any other range of values can be chosen as desired. This range addresses any chosen waveform and increases or decreases the amount of adjustment that the mapping applies. In effect, the adjustment scales the mapping.

Some waveforms are wider than others, i.e. there is a longer duty cycle, which means there is more energy in the waveform to drive the nozzle. More energy in terms of pulse width does not always result in ink deposition that is faster and larger. A preferred embodiment of the invention has a pulse width that is about eight microseconds, although the actual, optimal pulse width range may vary, based upon the print head, ink, etc. A presently preferred embodiment of the invention provides a pulse width that ranges up to about 8.2 microseconds for a single pulse. For a smaller duty cycle or smaller the nozzle-on time, less energy is put into the ink drop. The waveforms are characterized to relate the size of the ink drop and the velocity to each waveform for each nozzle to create a map for the defect.

In embodiments of the invention, an exemplary printer such as the Vutek HS100 uses the Seiko GS508 12 picoliter head. Embodiments of the invention characterize a family of heads based on defects in the heads and/or defects that are also printer mode dependent, e.g. the manner in which the print modes are interlaced can also present different defects. As such, it is advantageous in some cases to characterize the different modes.

Thus, a printer can have a library of lookup tables and, depending on the logic in the printer that identifies when the user has selected a certain mode, the printer selects a particular lookup table from the library. In other embodiments, where a print head manufacturer provides a comprehensive set of data for their print heads for use in a final test, which characterizes the individual nozzles, such data is used to create a lookup table automatically. Such table can then be adjusted if desired, based on experience with the printer.

Embodiments of the invention also provide a different table for each color ink in cases where the characteristics of each ink are different. For example, for clear ink or white ink that is characteristically different from other inks that are used in the printer, a different waveform set or a different lookup table can be provided.

The lookup table embodies the characteristic curve which negates the performance attribute. The performance attribute is analyzed and a curve or lookup table is created. However, it is not desirable to have a large differential between neighboring nozzles. If one nozzle is weak and its neighbor is strong, very different waveform sets should not be applied to neighboring nozzles or in chunks of neighboring nozzles to avoid having a prominent visible differential in the print. To avoid this artifact, the system dithers between waveforms such that the system does not adjust only, for example, ten nozzles with one waveform, then ten nozzles with the next waveform. Rather, the system adjusts, for example, three or four nozzles, then one nozzle, then another three nozzles, then two nozzles, and so on, to smooth the effect of the adjustment. Thus, the system blends the transitions.

Embodiments of the invention provide a dithering delta limit. As mentioned above, it is not desirable for the step between nozzles to be so large as to produce a noticeable artifact in the resulting print. Embodiments of the invention provide a 0.5 microseconds pulse for nozzle-on time as a maximum variation, where typical variation is between 0.1 and 0.2 microseconds. During a transition from one nozzle to the next nozzle the change in width of the waveform should not be more than, e.g. 0.5 microseconds. This limit to waveform deviation is also useful to address cross talk between neighboring nozzles, where one nozzle can affect another nozzle. A nozzle that is fired hard compared with its neighbor can affect the neighbor as well. The imposition of a dithering limit mitigates such cross talk.

With regard to print defects, the majority of the print head, e.g. 90% of the print head, exhibits noise in which there is minimal variation and no common trait of a defect in this portion of the head. This portion of the head is driven with the baseline waveform. Thus, the nozzles in the middle 90% of the print head are all typically driven normally with one standard waveform. To negate the different performance attributes at the end of the print head, such as due to thermal effects as discussed above, the system increases the drive applied to each nozzle, as described above, and overdrives the last 5% of the nozzles at each end of the print head. This flattens the curve by increasing the energy applied to the nozzles via the waveform for each nozzle as the nozzles are located increasingly from the center of the print head. Typically, only 5% to 10% of the nozzles at the end of the print head are corrected. It is not necessary in many cases to adjust the rest of the nozzles and these nozzles could be driven with a single waveform, depending on how the print head is characterized and/or the performance attribute that is to be negated.

In embodiments of the invention, the user may creatively adjust the curves to introduce special effects into the print. Thus, such embodiments the invention do not necessarily solve the defect, but rather introduce a special treatment for the print heads. As such, the user is provided with a user interface that includes a slider for increasing or decreasing the correction factor. Rather than changing the lookup table, the user changes the amplitude of the variation in the waveform applied to each nozzle from highest to lowest.

Embodiments of the invention are also used for correcting individual nozzles, e.g. nozzles that have a specific defect, such as a lazy nozzle. It is not desirable to replace the print head in view of such nozzle because the rest of the head is operating properly. In this case, the individual nozzle is driven with a different waveform to correct that error, thus extending the useful life of the print head.

Print heads can be characterized by data that is provided by the print head manufacturer or by data that is empirically generated, and such data is used to generate a lookup table. Thus, if there is a velocity defect, the manufacturer's characteristic velocity data, which is provided with every print head is used to create an individual lookup table per print head. The lookup table is then applied to every print head in the printer. As a result, the print head fires perfectly straight.

Normally, there are slight variations through the print head, e.g. a plus or minus 15% variation of velocity within a print head. Without correction a straight line does not come out perfectly straight, but is wavy because some of the nozzles are slower than others. The print head manufacturer provides that characteristic shape. In embodiments of the invention, the slow nozzles, fast nozzles, and average nozzles are identified. For example, a camera in the printer can look at dot positioning. In such cases, the printer prints a test pattern with a line of dots printed by one print head. The camera reads and analyzes the test pattern. The dot position from the camera is fed back into the printer to create a lookup table which corrects for the deviation or the velocity differences.

An inverse table is created based on that data, and then applied that to the print head by varying the waveforms provided to each nozzle in the print head on an individual basis. As a result, a straight print is produced. This does not necessarily solve temperature defect in the print head mentioned above, but only solves the individual dot positioning defect. As discussed above, the invention addresses the temperature defect. By picking a different waveform for each nozzle in the print head the system manipulates the ink delivery velocity.

Computer Implementation

Figure 12:
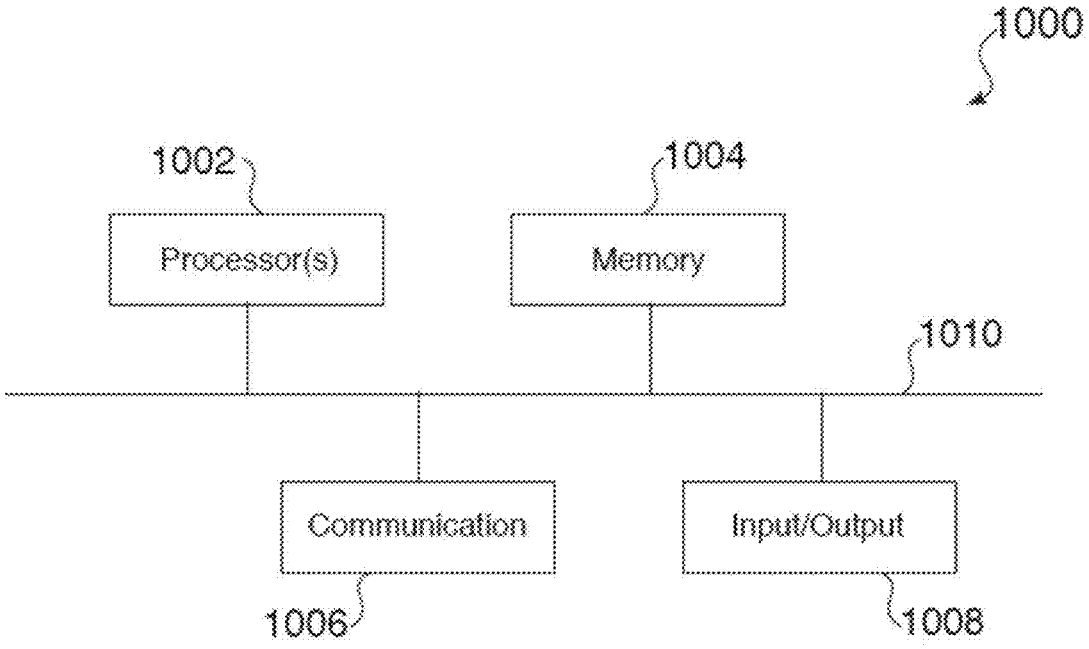
FIG. 12 is a block schematic diagram showing a machine in the example form of a computer system within which a set of instructions for causing the machine to perform one or more of the methodologies discussed herein may be executed.

FIG. 12 is a block diagram of a computer system that may be used to implement certain features of some of the embodiments of the invention. The computer system may be a server computer, a client computer, a personal computer (PC), a user device, a tablet PC, a laptop computer, a personal digital assistant (PDA), a cellular telephone, an iPhone, an iPad, a Blackberry, a processor, a telephone, a web appliance, a network router, switch or bridge, a console, a hand-held console, a (hand-held) gaming device, a music player, any portable, mobile, hand-held device, wearable device, or any machine capable of executing a set of instructions, sequential or otherwise, that specify actions to be taken by that machine.

The computing system 1000 may include one or more central processing units ("processors") 1002, memory 1004, input/output devices 1008, e.g. keyboard and pointing devices, touch devices, display devices, storage devices, e.g. disk drives, and communications devices 1006, e.g. network interfaces, that are connected to an interconnect 1010.

In FIG. 12, the interconnect is illustrated as an abstraction that represents any one or more separate physical buses, point-to-point connections, or both connected by appropriate bridges, adapters, or controllers. The interconnect, therefore, may include, for example a system bus, a peripheral component interconnect (PCI) bus or PCI-Express bus, a HyperTransport or industry standard architecture (ISA) bus, a small computer system interface (SCSI) bus, a universal serial bus (USB), IIC (12C) bus, or an Institute of Electrical and Electronics Engineers (IEEE) standard 1394 bus, also referred to as Firewire.

The memory 1004 and storage devices are computer-readable storage media that may store instructions that implement at least portions of the various embodiments of the invention. In addition, the data structures and message structures may be stored or transmitted via a data transmission medium, e.g. a signal on a communications link. Various communications links may be used, e.g. the Internet, a local area network, a wide area network, or a point-to-point dial-up connection. Thus, computer readable media can include computer-readable storage media, e.g. non-transitory media, and computer-readable transmission media.

The instructions stored in memory 1004 can be implemented as software and/or firmware to program one or more processors to carry out the actions described above. In some embodiments of the invention, such software or firmware may be initially provided to the processing system 1000 by downloading it from a remote system through the computing system, e.g. via the communications device 1006.

The various embodiments of the invention introduced herein can be implemented by, for example, programmable circuitry, e.g. one or more microprocessors, programmed with software and/or firmware, entirely in special-purpose hardwired, i.e. non-programmable, circuitry, or in a combination of such forms. Special-purpose hardwired circuitry may be in the form of, for example, one or more ASICs, PLDs, FPGAs, etc.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A method for optimizing the uniformity of performance of inkjet nozzles within a print head containing a plurality of said nozzles, comprising:

characterizing one or more performance attributes of said nozzles within said print head;

generating a waveform set comprising a plurality of waveforms to compensate for variations of said one or more performance attributes among said nozzles;

assigning one of the waveforms within said waveform set to each said nozzle to optimize said one or more performance attributes of each said nozzle relative to each other nozzle in said print head;

wherein, based upon said waveform assigned to each nozzle, each nozzle in said print head responds substantially uniformly relative to each other nozzle in said print head;

using performance of a predetermined portion of the nozzles comprising nozzles in a central portion of said print head as a baseline; and adjusting nozzles comprising nozzles outside of said central portion of said print head and not comprising nozzles within said predetermined portion by assigning a waveform to said outside nozzles to adjust said outside nozzles to approximate performance of the nozzles within said predetermined portion.

2. The method of claim 1, wherein said waveform set comprises a discrete, finite set of waveforms; and further comprising:

using a dithering operation to assign one of the waveforms to each nozzle.

3. The method of claim 2, further comprising:

using said dithering operation to smooth transitions between said discrete waveforms.

4. The method of claim 1, said performance attribute comprising any of:

gloss level and temperature of said print head.

5. The method of claim 1, further comprising:

characterizing said one or more performance attributes with a printed test pattern that is subsequently imaged and analyzed.

6. A method for optimizing the uniformity of performance of inkjet nozzles within a print head containing a plurality of said nozzles, comprising:

generating a characteristic look up table (LUT) to identify one or more performance attributes in said print head;

generating a waveform set to compensate for variations among said nozzles in said print head by driving said nozzles in accordance with said LUT across a full range of values for said performance attributes characterized by said LUT;

wherein each characteristic value allotted to each nozzle in said LUT references one waveform in said waveform set;

using each said waveform in said waveform set to drive a corresponding nozzle in said print head;

wherein each nozzle responds substantially uniformly relative to each other nozzle in response to said waveform;

using performance of a predetermined portion of the nozzles comprising nozzles in a central portion of said print head as a baseline; and adjusting nozzles comprising nozzles outside of said central portion of said print head and not comprising nozzles within said predetermined portion by assigning a waveform to said outside nozzles to adjust said outside nozzles to approximate performance of the nozzles within said predetermined portion.

7. The method of claim 6, further comprising:

dithering between transitions in the LUT that have a step response to generate smooth transitions between neighboring nozzles, wherein groups of nozzles that have a same LUT value are not immediately next to a group of nozzles with a different LUT value.

8. The method of claim 7, further comprising:

limiting changes in said dither pattern between neighboring nozzles to avoid steps and cross talk defects, wherein a step up or down of one LUT unit is permissible.

9. The method of claim 6, further comprising:

setting a portion of said LUT to said baseline waveform value to establish a continuous response for proximate nozzles within said predetermined portion of said nozzles in said print head.

10. The method of claim 6, further comprising:

generating the LUT from temperature related data.

11. The method of claim 6, further comprising:

generating the LUT from dot placement error related data.

12. The method of claim 6, further comprising:

generating the LUT from drop velocity related data.

13. The method of claim 6, further comprising:

providing a user adjustment for each waveform.

14. The method of claim 6, further comprising:

empirically generating said characteristic LUT from a printed test pattern that is scanned or captured and analyzed.

15. The method of claim 6, further comprising:

providing a user interface in which the LUT's are represented as a characteristic curve that is manually adjusted to compensate for variations among said nozzles in said print head, wherein said manual adjustment selects different waveform sets to apply to said performance attributes.

* * * * *